US006443588B1

(12) United States Patent
Nunez

(10) Patent No.: US 6,443,588 B1
(45) Date of Patent: Sep. 3, 2002

(54) LIGHTED CLIPBOARD DEVICE

(76) Inventor: Victor M. Nunez, 26019 Oak St., Apt. 9, Lomita, CA (US) 90717

( * ) Notice: Subject to any disclaimer, the term of this patent is extended or adjusted under 35 U.S.C. 154(b) by 0 days.

(21) Appl. No.: 09/802,569

(22) Filed: Mar. 9, 2001

(51) Int. Cl.[7] ..... F21V 33/00
(52) U.S. Cl. ..... 362/99; 362/98; 362/282
(58) Field of Search ..... 362/97, 98, 99, 362/277, 278, 282, 284, 319, 320, 322, 324, 335, 253, 396

(56) References Cited

U.S. PATENT DOCUMENTS 1,145,848 A 7/1915 Robins
2,029,425 A * 2/1936 Kaylor et al. ..... 362/99
3,297,862 A * 1/1967 Levy et al. ..... 362/99
3,694,644 A 9/1972 Bauknight
3,875,396 A 4/1975 Webb
D313,819 S 1/1991 Craft, Jr. et al.
5,148,356 A * 9/1992 Freese et al. ..... 362/277
5,280,415 A 1/1994 Barnette
5,502,623 A 3/1996 Brotz

* cited by examiner

*Primary Examiner*—Y. My Quach-Lee

(57) ABSTRACT

A lighted clipboard device for allowing a user to use a clipboard in dark areas. The lighted clipboard device includes a board member having a top side and a bottom side; and also includes a clip member being attached to the top side of the board member; and further includes a light-emitting assembly being attached to the clip member and to the board member.

15 Claims, 3 Drawing Sheets

LIGHTED CLIPBOARD DEVICE

BACKGROUND OF THE INVENTION

1. Field of the Invention

The present invention relates to a light-emitting clipboard and more particularly pertains to a new lighted clipboard device for allowing a user to use a clipboard in dark areas.

2. Description of the Prior Art

The use of a light-emitting clipboard is known in the prior art. More specifically, a light-emitting clipboard heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,502,623; 5,280,415; 1,145,848; 3,875,396; 3,694,644; and U.S. Pat. No. Des. 313,819.

While these devices fulfill their respective, particular objectives and requirements, the aforementioned patents do not disclose a new lighted clipboard device. The inventive device includes a board member having a top side and a bottom side; and also includes a clip member being attached to the top side of the board member; and further includes a light-emitting assembly being attached to the clip member.

In these respects, the lighted clipboard device according to the present invention substantially departs from the conventional concepts and designs of the prior art, and in so doing provides an apparatus primarily developed for the purpose of allowing a user to use a clipboard in dark areas.

SUMMARY OF THE INVENTION

In view of the foregoing disadvantages inherent in the known types of light-emitting clipboard now present in the prior art, the present invention provides a new lighted clipboard device construction wherein the same can be utilized for allowing a user to use a clipboard in dark areas.

The general purpose of the present invention, which will be described subsequently in greater detail, is to provide a new lighted clipboard device which has many of the advantages of the light-emitting clipboard mentioned heretofore and many novel features that result in a new lighted clipboard device which is not anticipated, rendered obvious, suggested, or even implied by any of the prior art light-emitting clipboard, either alone or in any combination thereof.

To attain this, the present invention generally comprises a board member having a top side and a bottom side; and also includes a clip member being attached to the top side of the board member; and further includes a light-emitting assembly being attached to the clip member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted clipboard device which has many of the advantages of the light-emitting clipboard mentioned heretofore and many novel features that result in a new lighted clipboard device which is not anticipated, rendered obvious, suggested, or even implied by any of the prior art light-emitting clipboard, either alone or in any combination thereof.

It is another object of the present invention to provide a new lighted clipboard device which may be easily and efficiently manufactured and marketed.

It is a further object of the present invention to provide a new lighted clipboard device which is of a durable and reliable construction.

An even further object of the present invention is to provide a new lighted clipboard device which is susceptible of a low cost of manufacture with regard to both materials and labor, and which accordingly is then susceptible of low prices of sale to the consuming public, thereby making such lighted clipboard device economically available to the buying public.

Still yet another object of the present invention is to provide a new lighted clipboard device which provides in the apparatuses and methods of the prior art some of the advantages thereof, while simultaneously overcoming some of the disadvantages normally associated therewith.

Still another object of the present invention is to provide a new lighted clipboard device for allowing a user to use a clipboard in dark areas.

Yet another object of the present invention is to provide a new lighted clipboard device which includes a board member having a top side and a bottom side; and also includes a clip member being attached to the top side of the board member; and further includes a light-emitting assembly being attached to the clip member.

Still yet another object of the present invention is to provide a new lighted clipboard device that is easy and convenient to use.

Even still another object of the present invention is to provide a new lighted clipboard device that reduces mistakes and misinformation because the user is able to write the information more legibly upon the clipboard when there is light to see what one's writing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
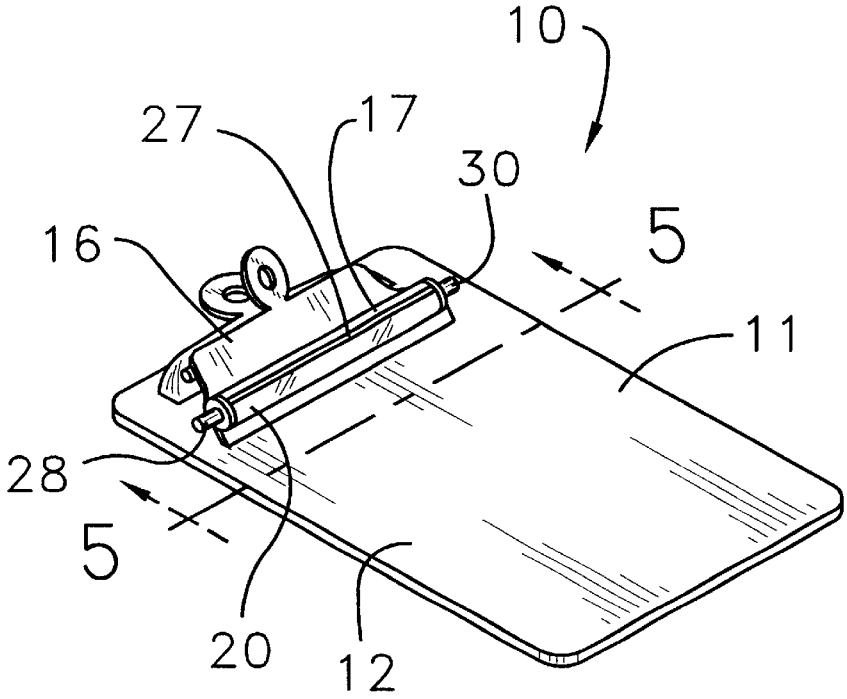
FIG. 1 is a perspective view of a new lighted clipboard device according to the present invention.
Figure 2:
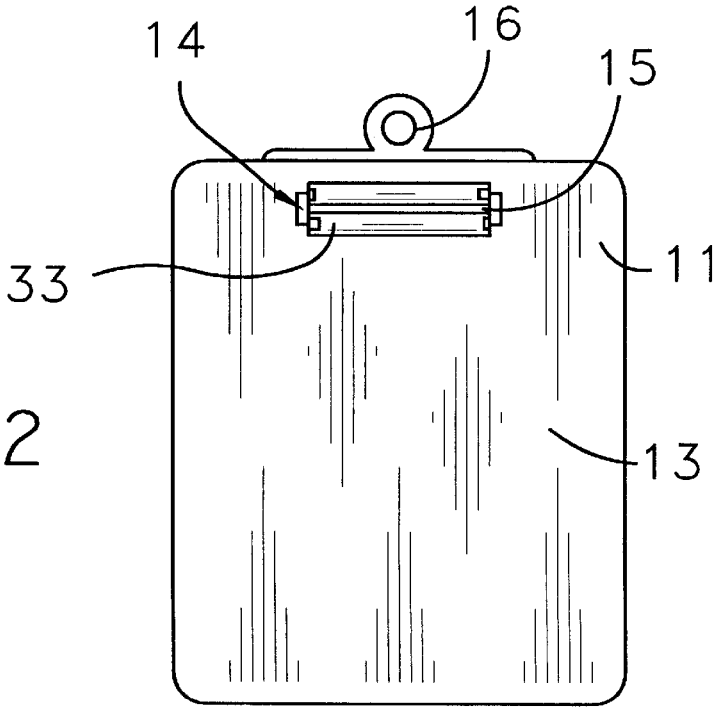
FIG. 2 is a top plan view of the present invention.
Figure 3:
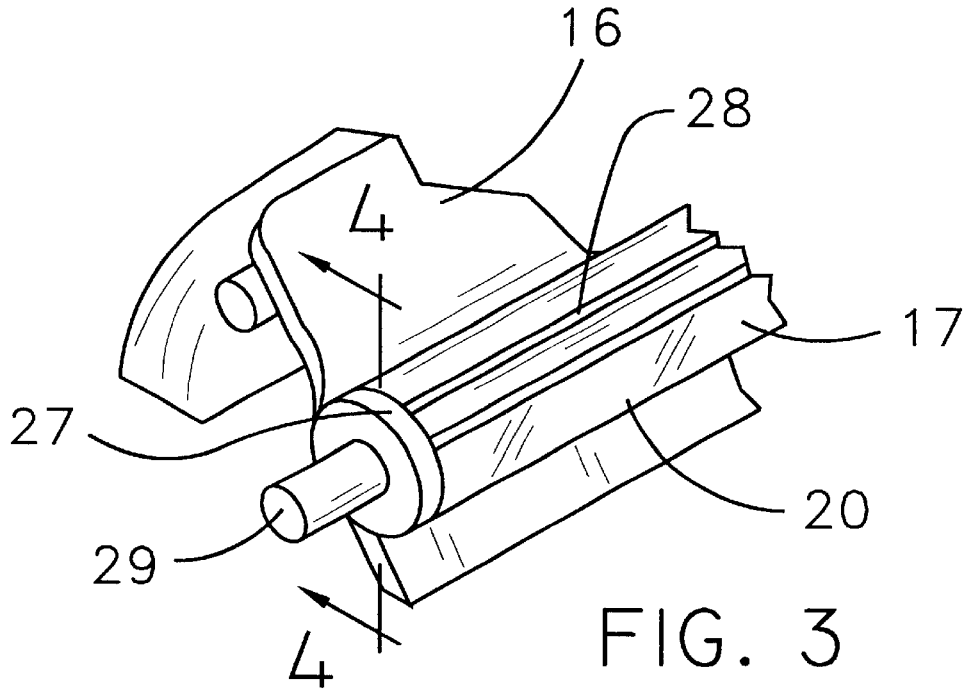
FIG. 3 is a detailed partial perspective view of the present invention.
Figure 4:
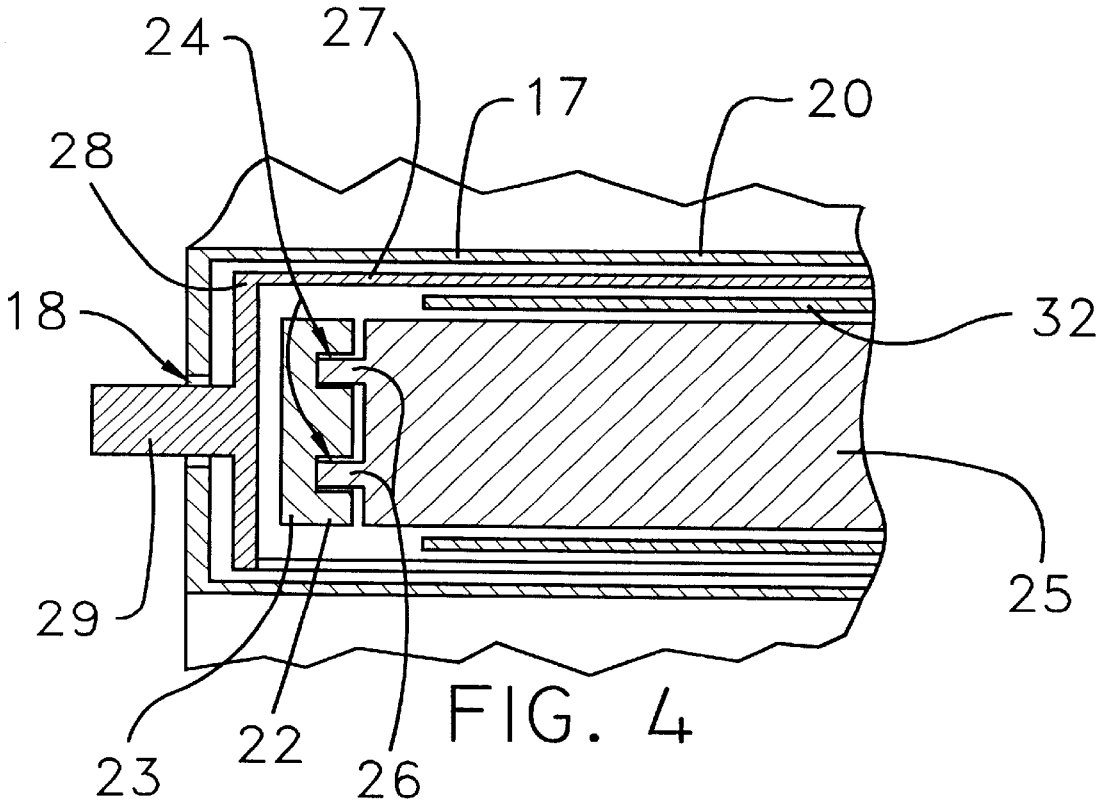
FIG. 4 is a detailed partial cross-sectional view of the present invention.
Figure 5:
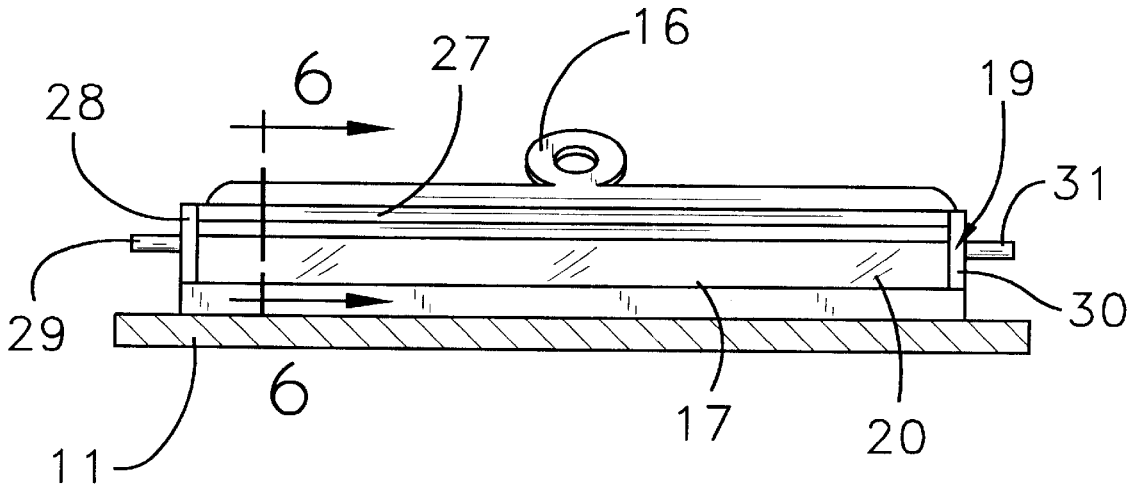
FIG. 5 is a lateral cross-sectional elevational view of the present invention.
Figure 6:
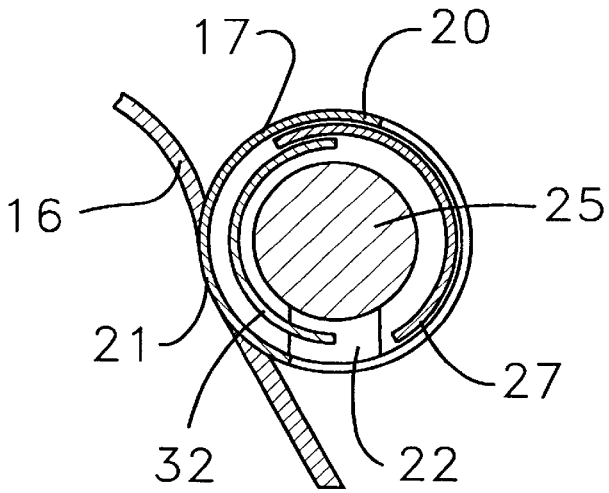
FIG. 6 is a cross-sectional view of the light-emitting assembly of the present invention.

With reference now to the drawings, and in particular to FIGS. 1 through 6 thereof, a new lighted clipboard device embodying the principles and concepts of the present invention and generally designated by the reference numeral 10 will be described.

As best illustrated in FIGS. 1 through 6, the lighted clipboard device 10 generally comprises a board member 11 having a top side 12 and a bottom side 13. The board member 11 includes a battery compartment 15 being disposed therein, and also includes an opening 14 being disposed through the bottom side 13 and into the battery compartment 15. A conventional clip member 16 is conventionally attached to the top side 12 of the board member 11.

A light-emitting assembly is attached to the clip member 16. The light-emitting assembly includes an elongate tubular housing 17 having a transparent side wall 20 and openings 18,19 through ends thereof, and also includes a light socket 22 being securely and conventionally disposed in the elongate tubular housing 17 near one of the ends thereof, and further includes a light-emitting member 25 being removably received in the light socket 22, and also includes a switch member 30 being conventionally attached to the elongate tubular housing 17 and being disposed through one of the openings 19 thereof and being conventionally connected to the light-emitting member 25, and further includes an adjustable shade member 27 being conventionally disposed between the side wall 20 of the elongate tubular housing 17 and the light-emitting member 25, and also includes a light reflector member 32 being conventionally disposed in the elongate tubular housing 17 for reflecting light through the transparent side wall 20 of the elongate tubular housing 17, and further includes a battery pack 33 being removably disposed in the battery compartment 15 and being conventionally connected to the switch member 30 for energizing the light-emitting member 25. The light socket 22 includes a body 23 having a plurality of terminal-receiving slots 24 disposed in a side thereof. The light-emitting member 25 includes a plurality of terminals 26 extending from an end thereof and being removably received in the terminal-receiving slots 24. The switch member 30 has a knob 31 extending outwardly from one of the openings 19 of the elongate tubular housing 17. The adjustable shade member 27 is a semi-cylindrical member 28 having a darkened side wall and having an adjustment knob 29 extending outwardly from an end thereof and through one of the openings 18 of the elongate tubular housing 17. The semi-cylindrical member 28 is rotatably disposed in the elongate tubular housing 17. The light reflector member 32 is a laterally-curved sheet of rigid material being disposed upon a back side 21 of the elongate tubular housing 17 which is securely and conventionally attached upon the clip member 16.

In use, the user energizes the light-emitting member 25 by turning on the switch member 30, and the user can adjust the amount of light being transmitted through the transparent side wall 20 of the elongate tubular housing 17 by adjusting the adjustable shade member 27. The user can rotate the semi-cylindrical member 28 over upon the light-emitting member 25 to essentially block some of the light being given off by the light-emitting member 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted clipboard device comprising:

a board member having a top side and a bottom side;

a clip member being attached to said top side of said board member; and a light-emitting assembly being attached to said clip member;

wherein said light-emitting assembly includes an elongate tubular housing having a transparent side wall and openings through ends thereof, and also includes a light socket being securely disposed in said elongate tubular housing near one of said ends thereof, and further includes a light-emitting member being removably received in said light socket, and also includes a switch member being attached to said elongate tubular housing and being disposed through one of said openings thereof and being electrically connected to said light-emitting member, and further includes an adjustable shade member being disposed between said side wall of said elongate tubular housing and said light-emitting member, and also includes a light reflector member being disposed in said elongate tubular housing for reflecting light through said transparent side wall of said elongate tubular housing, and further includes a battery pack being removably disposed in a battery compartment disposed in said board member and being electrically connected to said switch member for energizing said light-emitting member.

2. A lighted clipboard device as described in claim 1, wherein said board member includes an opening through said bottom side and into said battery compartment.

3. A lighted clipboard device as described in claim 1, wherein said light socket includes a body having a plurality of terminal-receiving slots disposed in a side thereof.

4. A lighted clipboard device as described in claim 3, wherein said light-emitting member includes a plurality of terminals extending from an end thereof and being removably received in said terminal-receiving slots.

5. A lighted clipboard device as described in claim 1, wherein said switch member has a knob extending outwardly from one of said openings of said elongate tubular housing.

6. A lighted clipboard device as described in claim 1, wherein said adjustable shade member is a semi-cylindrical member having a darkened side wall and having an adjustment knob extending outwardly from an end thereof and through one of said openings of said elongate tubular housing, said semi-cylindrical member being rotatably disposed in said elongate tubular housing.

7. A lighted clipboard device as described in claim 1, wherein said light reflector member is a laterally-curved sheet of rigid material being disposed upon a back side of said elongate tubular housing which is attached upon said clip member.

8. A lighted clipboard device comprising:

a board member having a top side and a bottom side, said board member including a battery compartment being disposed therein, and also including an opening through said bottom side and into said battery compartment;

a clip member being attached to said top side of said board member; and a light-emitting assembly being attached to said clip member, said light-emitting assembly including an elongate tubular housing having a transparent side wall and openings through ends thereof, and also including a light socket being securely disposed in said elongate tubular housing near one of said ends thereof, and further including a light-emitting member being removably received in said light socket, and also including a switch member being attached to said elongate tubular housing and being disposed through one of said openings thereof and being electrically connected to said light-emitting member, and further including an adjustable shade member being disposed between said side wall of said elongate tubular housing and said light-emitting member, and also including a light reflector member being disposed in said elongate tubular housing for reflecting light through said transparent side wall of said elongate tubular housing, and further including a battery pack being removably disposed in said battery compartment and being electrically connected to said switch member for energizing said light-emitting member, said light socket including a body having a plurality of terminal-receiving slots disposed in a side thereof, said light-emitting member including a plurality of terminals extending from an end thereof and being removably received in said terminal-receiving slots, said switch member having a knob extending outwardly from one of said openings of said elongate tubular housing, said adjustable shade member being a semi-cylindrical member having a darkened side wall and having an adjustment knob extending outwardly from an end thereof and through one of said openings of said elongate tubular housing, said semi-cylindrical member being rotatably disposed in said elongate tubular housing, said light reflector member being a laterally-curved sheet of rigid material and being disposed upon a back side of said elongate tubular housing which is securely attached upon said clip member.

9. A lighted clipboard device comprising:

a board member having a top side and a bottom side;

a clip member being attached to said top side of said board member; and a light-emitting assembly being attached to said clip member;

wherein said light-emitting assembly includes an elongate tubular housing having a transparent side wall, a light-emitting member being removably received in said tubular housing, an adjustable shade member being disposed between said side wall of said elongate tubular housing and said light-emitting member, and a light reflector member being disposed in said elongate tubular housing for reflecting light through said transparent side wall of said elongate tubular housing.

10. A lighted clipboard device as described in claim 9, wherein said tubular housing has openings through ends thereof, said light-emitting assembly further includes a light socket disposed in said elongate tubular housing near one of said ends thereof, a switch member being attached to said elongate tubular housing and being disposed through one of said openings thereof and being electrically connected to said light-emitting member, and a battery pack being removably disposed in a battery compartment disposed in said board member and being electrically connected to said switch member for energizing said light-emitting member.

11. A lighted clipboard device as described in claim 9, wherein said light socket includes a body having a plurality of terminal-receiving slots disposed in a side thereof.

12. A lighted clipboard device as described in claim 11, wherein said light-emitting member includes a plurality of terminals extending from an end thereof and being removably received in said terminal-receiving slots.

13. A lighted clipboard device as described in claim 9, wherein said switch member has a knob extending outwardly from one of said openings of said elongate tubular housing.

14. A lighted clipboard device as described in claim 9, wherein said adjustable shade member is a semi-cylindrical member having a darkened side wall and having an adjustment knob extending outwardly from an end thereof and through one of said openings of said elongate tubular housing, said semi-cylindrical member being rotatably disposed in said elongate tubular housing.

15. A lighted clipboard device as described in claim 9, wherein said light reflector member is a laterally-curved sheet of rigid material being disposed upon a back side of said elongate tubular housing which is attached upon said clip member.

* * * * *